US006551142B2

(12) United States Patent
Eisenbraun

(10) Patent No.: US 6,551,142 B2
(45) Date of Patent: Apr. 22, 2003

(54) VEHICLE CIGARETTE LIGHTER CONNECTOR

(75) Inventor: Kenneth D. Eisenbraun, Bloomfield Village, MI (US)

(73) Assignee: United Global Sourcing Incorporated, Troy, MI (US)

( * ) Notice: Subject to any disclaimer, the term of this patent is extended or adjusted under 35 U.S.C. 154(b) by 0 days.

(21) Appl. No.: 10/084,878

(22) Filed: Feb. 28, 2002

(65) Prior Publication Data

US 2002/0119708 A1 Aug. 29, 2002

Related U.S. Application Data

(60) Provisional application No. 60/272,269, filed on Feb. 28, 2001.

(51) Int. Cl.[7] ..... H01R 24/04
(52) U.S. Cl. ..... 439/668; 439/11
(58) Field of Search ..... 439/668, 11, 31, 439/502, 622

(56) References Cited

U.S. PATENT DOCUMENTS

| | | | | |
|---|---|---|---|---|
| 4,054,352 A | | 10/1977 | Rudin | |
| 4,109,988 A | | 8/1978 | Olson | |
| 4,248,494 A | | 2/1981 | McDonald et al. | |
| 5,249,970 A | * | 10/1993 | Jennings | 439/31 |
| 5,419,707 A | * | 5/1995 | Kelley | 439/668 |
| 5,690,509 A | | 11/1997 | Eisenbraun | 439/490 |
| 5,708,706 A | | 1/1998 | Hughes et al. | 379/446 |
| 5,716,219 A | * | 2/1998 | Noike | 439/31 |
| 5,775,952 A | * | 7/1998 | Lu | 439/668 |
| 5,829,993 A | | 11/1998 | Wu | 439/131 |
| 5,839,919 A | | 11/1998 | Chen | 439/529 |
| 5,860,824 A | | 1/1999 | Fan | 439/265 |
| 5,924,895 A | * | 7/1999 | Moji | 439/668 |
| 5,964,616 A | * | 10/1999 | Eisenbraun | 439/668 |
| 6,157,163 A | | 12/2000 | Blackwood | 320/115 |

* cited by examiner

*Primary Examiner*—Gary Paumen
(74) *Attorney, Agent, or Firm*—Gifford, Krass, Groh, Sprinkle, Anderson & Citkowski, P.C.

(57) ABSTRACT

A vehicle cigarette lighter connector having a barrel, a body pivotably secured to the barrel and a cable extending from the body. The barrel is preferably insertable into a vehicle cigarette lighter socket and has an end having indentations that are engagable by a detent pin on the body. The engagement of the detent pin in the indentations fixes the body in a predetermined orientation relative to the barrel. The body also includes a female connector into which can be inserted an additional male connector (such as another connector). A cable is secured at one end to the body. An adapter for an electrical device is preferably secured to the opposite end of the cable.

12 Claims, 2 Drawing Sheets

VEHICLE CIGARETTE LIGHTER CONNECTOR

RELATED APPLICATION

This application claims priority of U.S. Provisional Patent Application No. 60/272,269 filed Feb. 28, 2001, which is incorporated herein by reference.

BACKGROUND OF THE INVENTION

1. Field of the Invention

The present invention is directed to an electrical connector. More specifically, the present invention is directed to a connector for use with a vehicle cigarette lighter socket or similar vehicle power outlet.

2. Reference to Related Art

In recent years, the fast pace of today's modern economy has resulted in the movement of business outside of the boundaries of the traditional office space and into the automobile. The transition from office to automobile was aided in large part by the rapid advancement of portable electronic devices. These portable devices, which include cellular telephones, laptop and palm top computers, personal digital assistants and portable fax machines, assist the modern businessperson in communicating with clients or the main office. Unfortunately, the power hungry nature of these portable devices requires that they either be provided with a regular supply of batteries or connected to an external power source.

Electrical connectors that are adapted to engage the cigarette lighter socket of a vehicle are known in the art and have been utilized in providing electrical power to a wide range of electrical devices. However, the obvious drawback of using these traditional connectors is that the vast majority of automobiles are only equipped with a single cigarette lighter socket. Therefore, oftentimes it is only possible to power (or recharge) one device at a time.

The prior art suggests several systems for attempting to overcome this problem of powering only one device at a time. For example, U.S. Pat. No. 4,109,899 discloses the use of a duplex outlet device that plugs into a vehicle cigarette lighter socket. The outlet device includes a pair of sockets that permit the user to plug in the vehicle cigarette lighter and one other auxiliary piece of equipment. A similar device is also shown in U.S. Pat. No. 4,248,494.

U.S. Pat. No. 4,054,352 discloses an electrical power takeoff unit that is also adapted to be plugged into the vehicle cigarette lighter socket. This unit includes a socket into which the cigarette lighter may be inserted as well as a power cord. The power cord is capable of providing electrical power to accessories (such as a clock) that are placed in the vehicle.

Typically, the large and perhaps bulky nature of these prior art systems requires that newer systems be more flexible. In this regard, Japanese Patent Abstract 11-214099A discloses a plug having a terminal for a cellular telephone. The terminal is mounted on the end of the plug and is movable about a folding part positioned on the end of the plug. Likewise, U.S. Pat. No. 5,839,919 discloses a mobile phone fixing assembly that includes a cigarette lighter plug for inserting into the lighter socket of a car. The assembly includes an elongated flexible middle section.

However, what is clearly absent from the prior art is a compact positionable connector that is capable of providing power to multiple electronic devices.

SUMMARY OF THE INVENTION

The present invention is directed to a connector for use with a vehicle cigarette lighter socket. Preferably, the connector includes a barrel, a body that is pivotally secured to an end of the barrel and includes a female connector, and a cable that is secured at one end to the body and an adapter for an electrical device.

The barrel of the connector preferably has a generally tubular shape that is insertable into a standard vehicle cigarette lighter socket (or similar type of electrical receptacle). The barrel includes an end terminal and a pair of longitudinally extending side terminals that make electrical contact the cigarette lighter socket upon insertion of the barrel into the socket. A pivot end of the barrel is preferably rounded and includes at least two indentations.

A body is preferably pivotally mounted to the pivot end of the barrel. The body includes a front portion that includes a recess and a channel. A detent pin is positioned in a back wall of the channel and engages the indentations of the pivot end of the barrel. The body is selectively movable between the least two indentations of the pivot end of the barrel and is fixable by the user in a predetermined orientation with respect to said barrel.

The body of the connector also preferably includes an additional female connector (e.g., an additional electrical socket) into which a user may plug in another connector. A cable is preferably secured at one end to the body. An adapter for an electrical device is preferably positioned on the opposite end of the cable.

BRIEF DESCRIPTION OF THE DRAWING

A better understanding of the present invention will be had upon reference to the detail description and attached drawings, wherein like reference numbers refer to like parts throughout, and wherein.

DETAILED DESCRIPTION OF THE PREFERRED EMBODIMENTS

Figure 1:
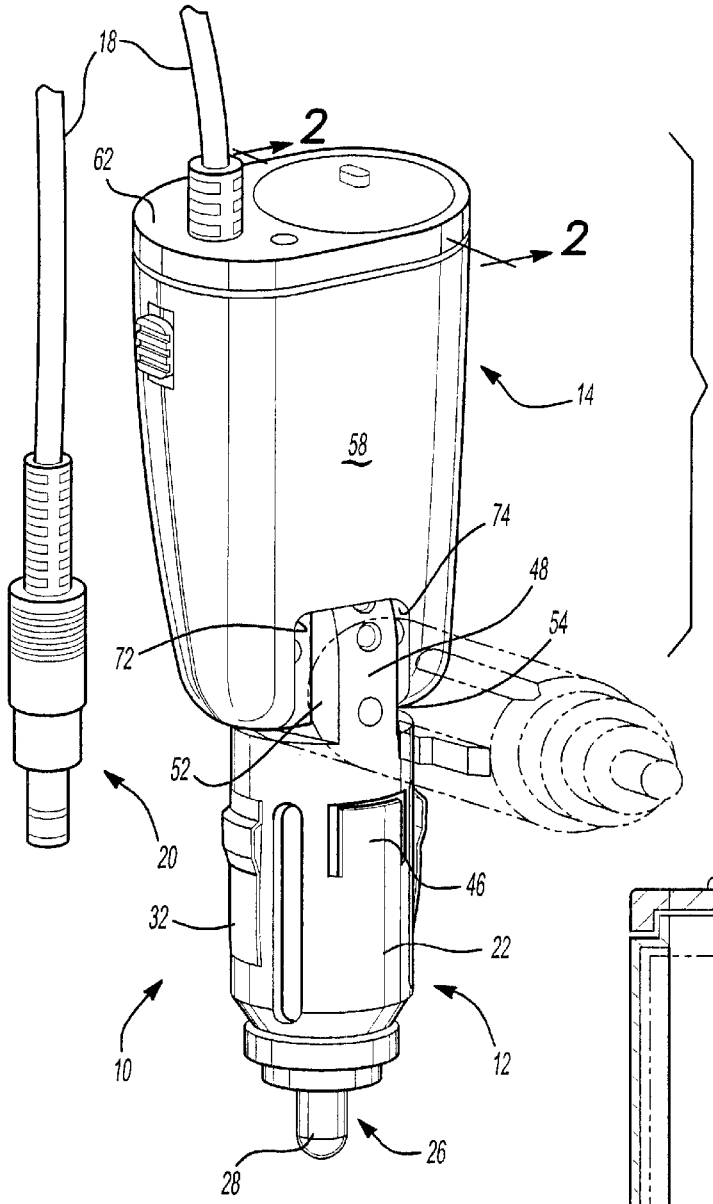
FIG. 1, is a perspective view of a connector constructed in accordance with the present invention.

Referring now to FIG. 1, there is shown a vehicle cigarette lighter connector 10 constructed in accordance with the present invention for use with a vehicle cigarette lighter socket (not shown) or a similar type of electrical receptacle. Preferably, the connector 10 of the present invention includes a barrel 12, a body 14 having a female connector 16 that is pivotally secured to the barrel 12, a cable 18 that is secured at one end to the body 14 and an adapter 20 for electrical device.

Figure 3:
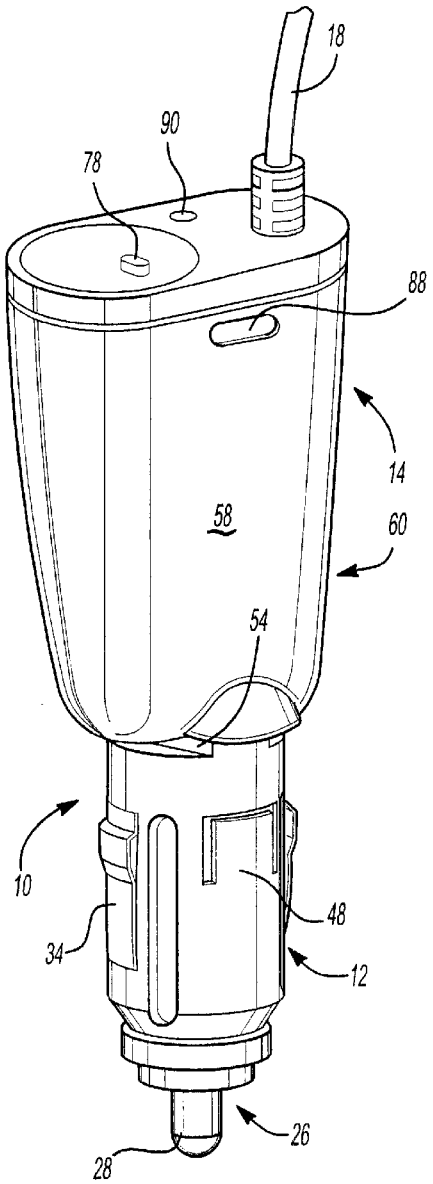
FIG. 3, is a perspective rear view of the connector shown in FIG. 1.
Figure 4:
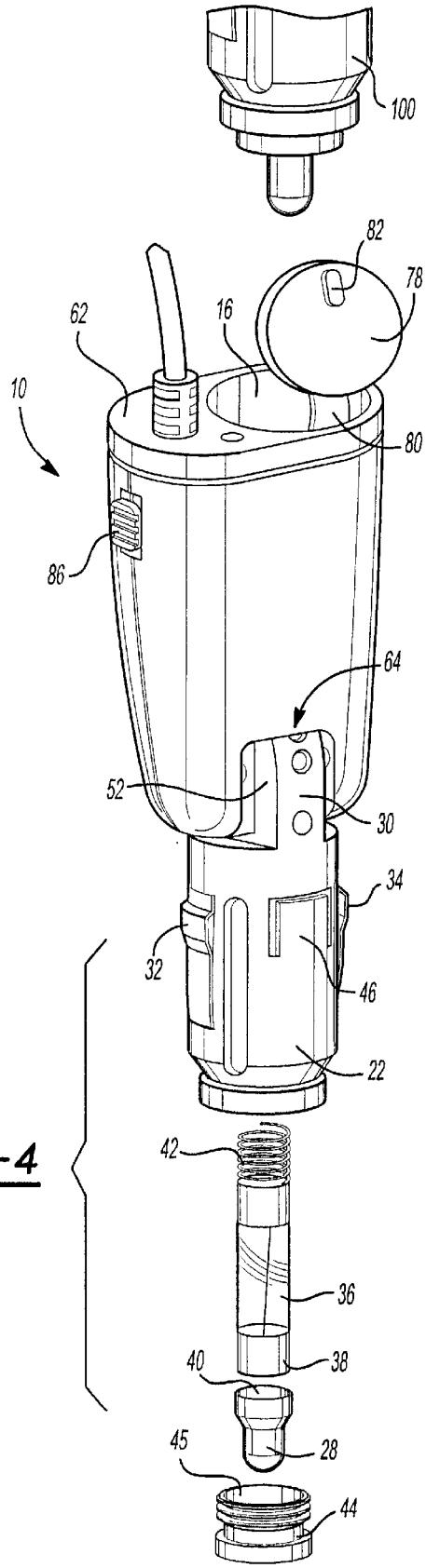
FIG. 4, is an exploded perspective view of the connector shown in FIG. 1.

Referring now to FIGS. 1, 3 and 4, the barrel 12 of the present invention is preferably an elongated tubular structure having an exterior surface 22 and a longitudinal axis. Preferably, the barrel 12 is constructed of a moldable plastic. However, it will be appreciated that other formable materials such as aluminum, alloys and known synthetic materials may also be used in the construction of the barrel 12.

Still referring to FIGS. 1, 3 and 4, the barrel 12 preferably includes a contact end 26 having an end terminal 28 and a pivot end 30 opposite the contact end 26. A first 32 and a second 34 side terminal are preferably placed in diametrically opposed positions to each other and extend longitudinally along on the exterior surface 22 of the barrel 12.

As best shown in FIG. 4, a fuse 36 is preferably disposed in the interior (not shown) of the barrel 12. Preferably, one end 38 of the fuse 36 is upwardly biased against the base 40 of the end terminal 28 by a spring 42. The spring 42, fuse 36 and end terminal 28 are thus preferably retained in the barrel 12 by use of an end cap 44 that threadably engages the contact end 26 of the barrel 12. An aperture 45 in the end cap 44 permits the end terminal 28 to extend outwardly through the cap 44 such that the end terminal 28 can engage the vehicle cigarette lighter socket.

Referring now to FIG. 1, the barrel 12 also preferably includes a pair of retainer clips 46, 48. The retainer clips 46, 48 extend from the exterior surface 22 of the barrel 12 and assist in securing the barrel 12 in the vehicle cigarette lighter socket. As it is known, the side terminals 32, 34 and end terminal 28 make electrical contact with the vehicle cigarette lighter socket upon insertion of the connector 10 into the socket.

Figure 2:
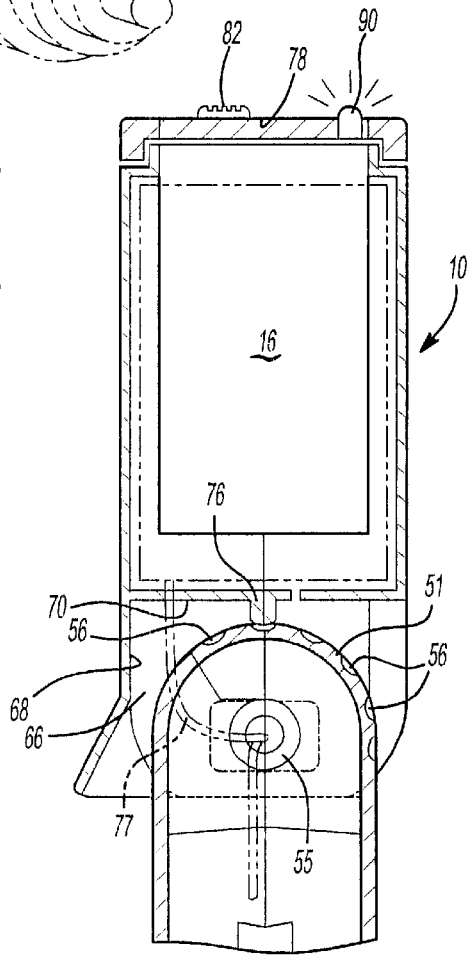
FIG. 2, is cut-away view of the connector taken along line 2—2 of FIG. 1.

Referring now to FIGS. 2 and 4, the pivot end 30 of the barrel 12 preferably includes a rounded tongue portion 48 having a surface 51 and a pair of sidewalls 52, 54. The surface 51 of the pivot end 30 also preferably includes at least two indentations 56. A pivot arm 55 (see FIG. 2) extends from each side wall 52, 54 and engages the body 14 of the connector 10 as will be discussed below.

Referring now to FIGS. 1–4, the body 14 of the connector 10 preferably includes an exterior surface 58, a front portion 60 and a rear wall 62. As best shown in FIGS. 2 and 4, the front portion 60 of the body 14 includes a recess 64 and a channel 66. Preferably, the channel 66 includes a base 68, a back wall 70 and a pair of opposing sidewalls 72, 74. A detent pin 76 (see FIG. 2) is preferably positioned on and extends from a flexible cut-away portion of the back wall 70 of the channel 66. However, it will be appreciated the detent pin may be biased into position by the use of a spring or the like.

As can be seen from FIGS. 1 and 2, the pivot end 30 of the barrel 12 is adapted to be fitted into the channel 66 of the body 14 with the pivot arms 55 engaging openings (not shown) disposed in the side walls 72, 74 of the channel 66. In this arrangement, the detent pin 76 of the back wall 70 of the channel 66 engages the indentations 56 of the pivot end 30 of the barrel 12. Therefore, it will be appreciated that the body 14 of the connector may be moved about the pivot end 30 of the barrel 12 upon insertion of the barrel 12 into the vehicle cigarette lighter socket (not shown). Furthermore, the engagement of the detent pin 76 in the indentations 56 permits a user to select the orientation of the body 14 relative to the barrel 12 when the barrel 12 is inserted into the vehicle cigarette lighter socket.

Referring now to FIGS. 1 and 4, the female connector 16 is disposed within the interior of the body 14. Preferably, the female connector is a power receptacle similar to the vehicle's cigarette lighter socket. As seen in FIG. 2, a wire 77 is threaded through one of the pivot arms 55 of the barrel 12 such that the female connector 16 is in electrical contact with the terminals 28, 32, 34 of the barrel 12. When not in use, the female connector 16 is closed by a cover plate 78 that is secured to the rear wall 62 of the body 14 by a flexible hinge 80. Preferably, the cover plate 78 is releasably secured to the body 14 by a latch 82. As shown in FIG. 4, the female connector 16 is preferably engaged by a male connector 84, such as a connector 100.

Referring now to FIG. 1, a cable 18 is preferably secured at one end to the rear wall 62 of the body 14 and is in electrical contact with the terminals 28, 32, 34 of the barrel 12 via a wire (not shown) that is threaded through one of the pivot arms 55 of the barrel 12.

A switch 86 is preferably positioned on the exterior surface 58 of the body 14 to permit a user to turn on or turn off electrical power to the cable 18 and the adapter 20. Alternatively, the switch 86 may be used to control power to the female connector 16 or the combination of the cable 18 and the female connector 16.

An adapter 20 is secured to an opposite end of the cable 18. The adapter 20 is a preferably male electrical connector for an electronic device (e.g., a connector for a cellular telephone, laptop or palm top computer, PDA or portable fax machine). However, it will be appreciated that the adapter 20 may also include a female connector or any one of a variety of commercially available power adapters capable of electrically contacting an electronic device.

A first light 88, which is activated by the switch 86, is positioned on the surface 58 of the body 14 to indicate when electrical power is being supplied to the cable 18 and the adapter 20.

Referring now to FIGS. 1–4, a second light 90 is preferably positioned on the rear wall 62 of the body 14 and is activated whenever the terminals 28, 32, 34 of the barrel 12 are making electrical contact with the vehicle cigarette lighter socket.

Having thus described my invention, various embodiments and adaptations that do not depart from the scope of the prior art will be apparent to those having skill in the art.

I claim:

1. A vehicle cigarette lighter connector comprising:

a barrel insertable into a vehicle cigarette lighter socket and having an electrical terminal which makes electrical contact with said socket upon insertion of said barrel into said socket;

a body pivotably mounted to said barrel and adapted to be fixed in a predetermined orientation with respect to said barrel and having a female connector in electrical contact with said electrical terminal of said barrel;

an electrical cable secured at one end to said body so as to be in electrical contact with said terminal; and an electrical adapter secured to an opposite end of said cable and being in electrical contact with said electrical terminal.

2. The vehicle cigarette lighter connector of claim 1, wherein said barrel further comprises a pivot end, said pivot end having at least two indentations.

3. The vehicle cigarette lighter connector of claim 2, wherein said body further comprises a detent pin, said detent pin being adapted to releaseably engage one of said at least two indentations of said pivot end of said barrel.

4. The vehicle cigarette lighter connector of claim 1, wherein said barrel further comprises a pair of retaining clips.

5. The vehicle cigarette lighter connector of claim 1, wherein said electrical terminal is an end terminal and said barrel further comprises a first side terminal and a second side terminal.

6. The vehicle cigarette lighter connector of claim 1, wherein said body further comprises a light that is activated when electrical power is being provided to said female connector of said body.

7. The vehicle cigarette lighter connector of claim 1, wherein said body further comprises a light that is activated when electrical power is being supplied to an electrical device through said adapter.

8. The vehicle cigarette lighter connector of claim 1, wherein said barrel further comprises a fuse electrically connected to said electrical terminal.

9. The vehicle cigarette lighter connector of claim 1, wherein said body further comprises a cover plate hingedly secured to said body and being adapted to close said female connector.

10. The vehicle cigarette lighter connector of claim 9, wherein said cover plate further comprises a latch.

11. A vehicle cigarette lighter connector comprising:

a barrel insertable into a vehicle cigarette lighter socket having a pivot end and an end terminal, said end terminal making electrical contact with said vehicle cigarette lighter socket upon insertion of said barrel into said vehicle cigarette lighter socket, said pivot end of said barrel having a plurality of indentations;

a body pivotably mounted to said pivot end of said barrel having a female connector in electrical contact with said end terminal of said barrel, a detent pin adapted to releasably engage said indentations of said pivot end such that said body is selectively movable between said at least two indentations and fixable in a predetermined orientation with respect to said barrel and at least one light that is activated when electrical power is being supplied to said female connector;

an electrical cable secured at one end to said body so as to be in electrical contact with said terminal; and an electrical adapter secured to an opposite end of said cable and being in electrical contact with said electrical terminal.

12. A vehicle cigarette lighter connector comprising:

a barrel insertable into a vehicle cigarette lighter socket having an end terminal and a first and a second side terminal, each of said end and side terminals making electrical contact with said vehicle cigarette lighter socket upon insertion of said barrel into said vehicle cigarette lighter socket, a pair of retainer clips adapted to secure said barrel in vehicle cigarette lighter socket and a pivot end having a plurality of indentations;

a body pivotably mounted to said pivot end of said barrel having a female connector in electrical contact with said end terminal and said side terminals of said barrel and having a detent pin adapted to releasably engage said indentations of said pivot end such that said body is selectively movable between said at least two indentations and fixable in a predetermined orientation with respect to said barrel;

an electrical cable secured at one end to said body so as to be in electrical contact with said end terminal and said side terminals; and and an electrical adapter secured to an opposite end of said cable and being in electrical contact with said end terminal and said side terminals.

* * * * *